United States Patent [19]

Watts

[11] Patent Number: 4,773,390

[45] Date of Patent: Sep. 27, 1988

[54] DEMAND HOT WATER SYSTEM

[75] Inventor: David O. Watts, Tulsa, Okla.

[73] Assignee: The Quik Company, Tulsa, Okla.

[21] Appl. No.: 114,582

[22] Filed: Oct. 30, 1987

[51] Int. Cl.[4] ..... F24H 1/10

[52] U.S. Cl. ..... 126/355; 126/359; 122/412; 122/417; 122/28

[58] Field of Search ..... 126/350 R, 355, 359; 122/31 R, 208, 28, 417, 421, 414, 412

[56] References Cited

U.S. PATENT DOCUMENTS

| | | | |
|---|---|---|---|
| 3,826,240 | 7/1974 | Miyahara | 126/359 X |
| 4,530,347 | 7/1985 | Baker et al. | 126/360 A X |
| 4,574,775 | 3/1986 | Lutzes et al. | 126/359 |

*Primary Examiner*—Randall L. Green
*Attorney, Agent, or Firm*—Head & Johnson

[57] ABSTRACT

A high efficiency gas hot water heater has a vertical cylindrical water tower and a cylindrical combustion chamber secured to the wall of the vertical water tower and extending horizontally therefrom. The combustion chamber has means at the outer end for the injection of gas and air therein, the products of combustion of gas and air produced in the combustion chamber flowing into the vertical water tower which has, at its upper end, a flue. A generally horizontal water distributor is positioned within the water tower adjacent to the top. A water jacket surrounds the combustion chamber with piping providing a water inlet into the water jacket and from the water jacket into the water distributor so that the products of combustion of the gas and air in the combustion chamber flow into the vertical water tower and upwardly therethrough as water flows downwardly therethrough. The heat of the products of combustion is exchanged with the down pouring of water so that substantially all of the heat of the combustion is transferred to the water. In a preferred arrangement packing is provided within the vertical water tower above the combustion chamber and below the water distributor to more effectively comingle the products of combustion with the down flowing water.

5 Claims, 2 Drawing Sheets

DEMAND HOT WATER SYSTEM

SUMMARY OF THE INVENTION

This invention is a demand-type hot water heater having extremely high efficiency. By high efficiency is meant that gas, mixed with air, is burned and the heat of combustion is transferred from the products of combustion to water in such a way that about 98% of the gross heat of combustion is transferred to the water resulting in a heat loss of not more than about 2%.

The high efficiency gas hot water heater is formed of a water tower having a vertical cylindrical wall with an upper end and a lower end. An exhaust gas vent is provided in the upper end. A hot water outlet is provided in the water tower adjacent the lower end and a hot water inlet is adjacent the upper end. A large diameter combustion inlet opening is formed in the water tower's vertical cylindrical wall.

A cylindrical combustion chamber is secured to the water tower at the large diameter opening and extends horizontally. The combustion chamber has an inner end secured to the water tower and a closed outer end. An air inlet is provided adjacent the outer end and a gas inlet opening is formed in the combustion chamber's outer end.

An air blower has the air outlet thereof connected to the air inlet in the combustion chamber, so that air under pressure is forced into the combustion chamber. A gas burner extends within the combustion chamber through the gas inlet opening.

In some embodiments of the invention the burner and fan are combined as a unit and mounted onto the combustion chamber.

A water jacket is secured around the horizontal combustion chamber, providing a closed annular area between the interior of the water jacket and the exterior of the combustion chamber. Water inlet and water outlet openings are provided in the water jacket.

A generally horizontal water distributor is positioned within the water tower adjacent the upper end and connected to the water inlet. Piping is provided to conduct water from the water jacket outlet to the water distributor and piping is also provided to connect inlet water to the water jacket inlet.

Gas mixed with air is burned within the combustion chamber. The products of combustion move from the horizontal combustion chamber into the vertical water tower. The products of combustion move upwardly through the vertical water tower to ultimately pass out through the flue. As the product of combustion move upwardly, they encounter the down flowing water and the heat of combustion is transferred to the water. To improve the efficiency of heat transfer from the products of combustion to the water, packing is provided in the vertical tower above the combustion gas inlet opening and below the water distributor. The packing permits the products of combustion to flow upwardly therethrough and water to trickle downwardly therethrough, so that intimate comingling results in ultimate heat transfer between the product of combustion and the water.

The arrangement of the high efficiency gas hot water heater permits the flame to burn without being quenched. The flame of combustion does not encounter the down flowing water in the vertical water tower. No fuel is lost due to incomplete combustion, as there is no raining of water onto the fire of combustion.

The invention achieves an exceedingly high gross efficiency which far exceeds that of the typical boiler or conventional hot water heater. This efficiency is achieved by the thorough intermingling of the products of combustion and the water. Even the moisture formed from combustion is condensed in the packed column tower that cools the products of combustion as the water is heated. The result is an extremely low vent gas temperature, so that no hot stack gases need to be contended with. In the typical application of the invention, the vent gas temperature will be less than 100° F.

The advantages of the hot water heater of this invention lend themselves to the provisions of a demand hot water heater, that is, where water is heated as required rather than heated in advance of requirement. This also results in an increased efficiency since heated water waiting to be used is a source of heat leakage to the environment, as is a common problem with boiler and typical hot water heaters.

Other hot water heaters, and particularly the type wherein the products of combustion are directly comingled with water to produce hot water, are disclosed in the following U.S. Pats. Nos. 628,048, 3,204,629, 884,223, 3,994,281, 3,386,436, 4,574,775, 3,190,283, 3,648,682, 4,596,235.

While each of these prior issued patents shows hot water heating systems of the type wherein the products of combustion are directly comingled with water to produce hot water, none show the advantages of the present invention. In particular, none show the arrangement wherein the flame of combustion is in a horizontal combustion chamber and the comingling of the gases and water take place in a vertical water tower in an arrangement which positions flame of combustion from direct contact from the water being heated and which is one factor which permits the high degree of efficiency obtained in the present invention.

DESCRIPTION OF THE PREFERRED EMBODIMENT

Figure 1:
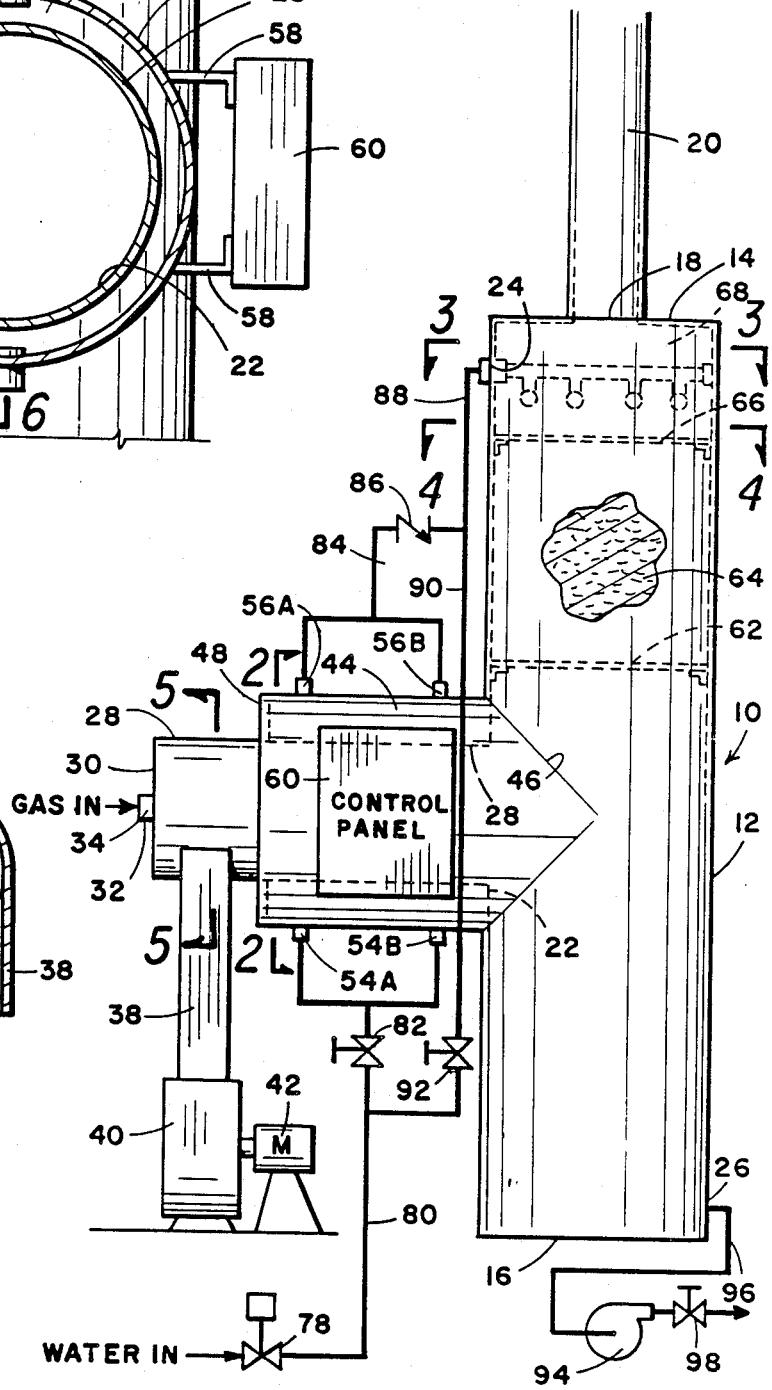
FIG. 1 is an elevational view, shown partially cut away, of a demand high efficiency hot water heating system of the present invention.

Referring to FIG. 1, the basic elements making up the high efficiency gas hot water heater system are illustrated. One of the basic elements is a water tower, generally indicated by the numeral 10. The water tower is formed by a vessel having a vertical cylindrical wall 12, an upper end 14 and a bottom end 16. The upper end 14 is provided with an opening 18 to which is connected a flue vent 20.

Formed in this cylindrical wall 12 is a large diameter combustion gas inlet opening 22. In the cylindrical wall adjacent the upper end 14, is a water inlet opening 24 and adjacent the lower end 16 is a water outlet 26.

Figure 2:
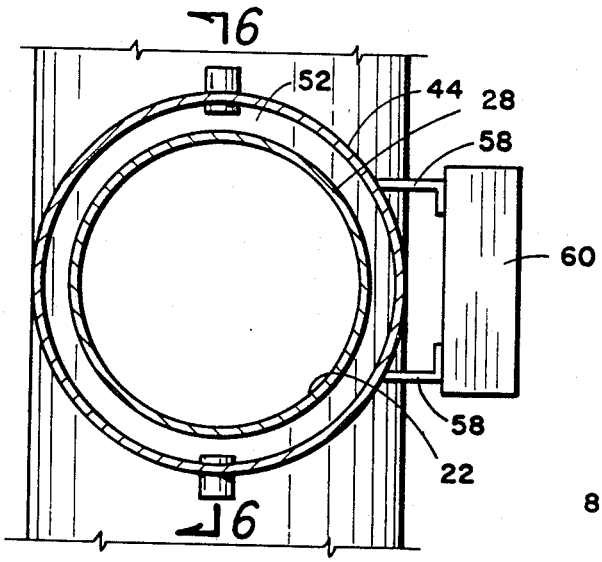
FIG. 2 is a cross-sectional view of the combustion chamber and water jacket taken along the line 2—2 of FIG. 1.
Figure 5:
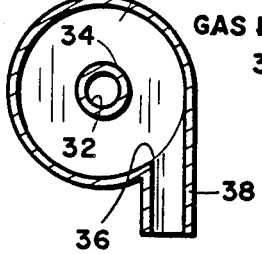
FIG. 5 is a cross-sectional view of the combustion chamber taken along the line 5—5 of FIG. 1.

Secured to the water tower cylindrical wall 12 is a horizontal combustion chamber 28 which has a closed outer end 48. The inner end of the combustion chamber 28 is secured to the water tower cylindrical wall 12. A gas connection 32 is formed in the closed end 30 of a burner 28 and receives the burner pipe 34. (See FIG. 5)

Also, formed in the cylindrical wall of the combustion burner 28 is an air inlet opening 36 (See FIG. 5) to which is connected an air duct 38 which in turn is connected to a blower 40 driven by a motor 42. In some embodiments of the invention the burner and fan are combined as a unit and mounted onto the combustion chamber.

Positioned in annular arrangement around the combustion chamber 28 is a water jacket 44. The inner end 46 of the water jacket connects to the exterior of the water tower cylindrical wall 12. The outer end 48 of the water jacket is closed providing an annular space 52 between the interior of the water jacket 44 and the exterior of the combustion chamber 28.

Water jacket 44 has two inlet openings 54A and 54B and two water outlet openings 56A and 56B. It can be seen that only a single water inlet and a single water outlet opening may be employed to practice the principles of the invention.

Secured to the exterior of the water jacket 44 is bracket 58 supporting control panel 60.

Positioned within the interior of the water tower 10 above the combustion gas inlet opening 22 is a foranimous shelf 62. Supported on shelf 62 within the upper portion of the interior of the water tower is packing 64. The packing 64 may be of the type commonly employed in chemical treatment processes and preferably of the type which is not rusted or corroded by water. To retain packing 16 within its confined space within the upper end of the water tower, a foranimous cover 66 is employed. Both the shelf 62 and the cover 66 are of the type formed such as by expanded metal or the like which freely permits the flow of combustion gases upwardly therethrough and the flow of water downwardly therethrough, while nevertheless retaining the packing 64 in position.

Figure 3:
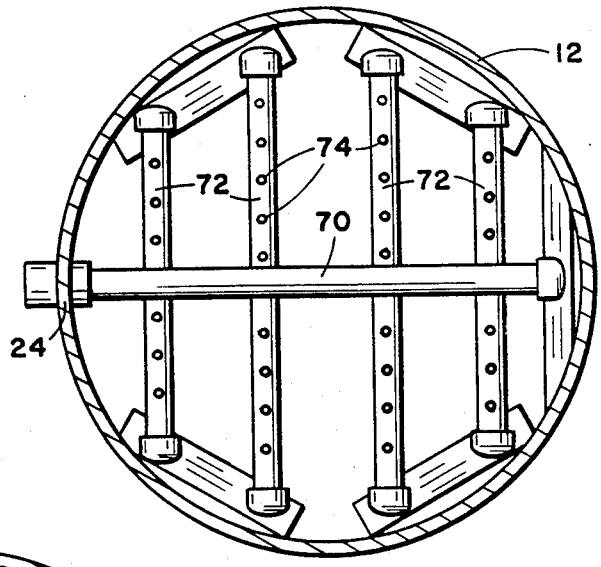
FIG. 3 is a horizontal cross-sectional view of the upper portion of the water tower showing one configuration of the water distributor within the water tower.

Positioned within the upper end of the water tower is a water distributor, generally indicated by the numeral 68. As shown best in FIG. 3, the water distributor may be in the form of a vertical or horizontal main supply pipe 70 connecting to a plurality of parallel spaced distribution pipe 72 which extends at right angle to the supply pipe 70. The distribution pipe 72 has a plurality of spaced apart small openings 74 therein. Water passing through inlet opening 24 is discharged through opening 24 to be more or less evenly distributed in the top of the water tower. The openings 74 are shown on the top of the distributor pipe 72, but it can been seen that they can equally as well be placed on the bottom.

Figure 4:
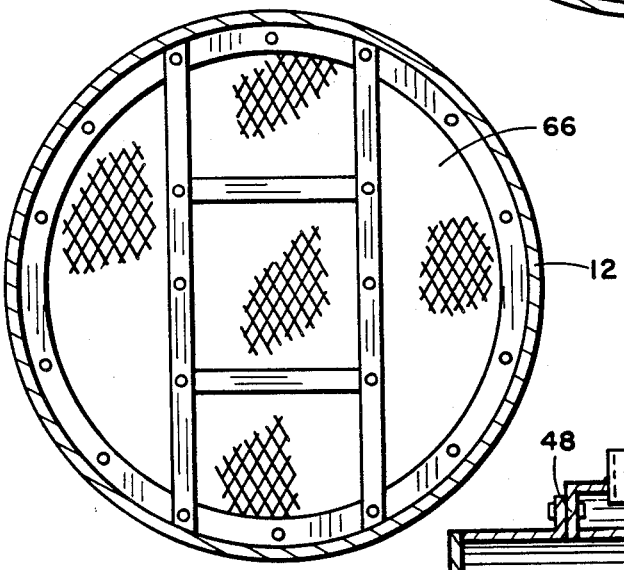
FIG. 4 is a horizontal cross-sectional view taken along the line 4—4 of FIG. 1 showing the cover formed over the area containing packing within the water tower.
Figure 6:
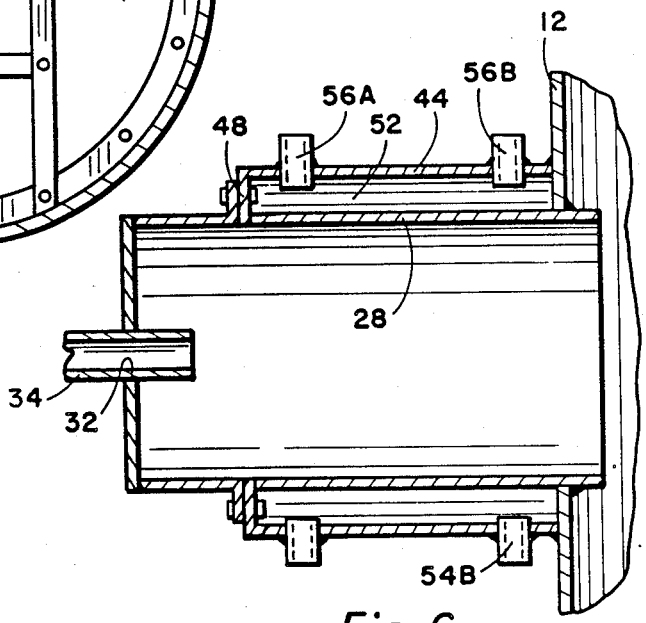
FIG. 6 is a vertical cross-sectional view taken along the line 6—6 of FIG. 2 showing more details of the combustion chamber and the water jacket.

FIG. 4 shows one type of construction for the cover 66 which is formed by a grid such as of expanded metal with reinforcing structural members as necessary to retain the cover in a generally flat configuration. The shelf 62 may be likewise constructed, however, the details of construction of shelf 62 and cover 66 are not critical portions of the invention. In like manner, the specific means of providing uniform distribution of inlet water across the top of the water tower can be achieved by means other than those shown in FIG. 3 which is merely an illustration of a preferred embodiment.

Inlet water passing through conduit 76 flows through an inlet control valve 78 and by conduit 80 through a distributor valve 82 to the water jacket and water inlets 54A and 54B. The water flows from within the annular area 52 inside the water jacket through the water outlets 56A and 56B by a conduit 84 and thence through a check valve 86 and by conduit 88 to the water inlet 24. Thus, the inlet water is exposed to the heat generated within combustion chamber 28 before it is injected into the water tower 10. Alternate piping 90 has a sitributor valve 92 in series therewith and permits the passage of inlet water directly into the interior of the water tower when desired. By regulating the distributor valves 82 and 92, the ratio of water passing through the water jacket annular area 52 may be regulated.

In practice, the hot water heater functions only when hot water is desired. The means of temperature controls are not shown, since they are a common expedient in controlling hot water heaters or boilers. Upon a signal indicating the demand for hot water, gas is injected into burner 34 and immediately ignited. The specific arrangements of the burner, including the igniter and so forth are not shown in detail, since they are commonly employed features with burners.

As soon as the gas is ignited the fan motor 42 is energized forcing compressed air through the air conduit 38 into the combustion chamber 28 so that rapid combustion gas and air takes place within the combustion chamber. The products of combustion, that is, the hot gases of combustion, move directly out of the horizontal combustion chamber into the vertical water tower 10. These hot gases of combustion flow upwardly within the water tower, through the shelf 62, through packing 64, through cover 66 and ultimately out through flue vent 22 for discharge to the atmosphere. As the hot gases move upwardly, control valve 78 is actuated permitting water to flow through the annular area 52 within the water jacket 44 and into the water distributor 68. As the water leaves the water distributor it passes downwardly within the water tower, through cover 66, packing 64 and shelf 62 into the lower portion of the water tower 10. The water absorbs the heat of the products of combustion. The heated water accumulates within the lower portion of the water tower. The heater water is available under pressure by means of a water pump 94 connected to piping 96 extending from the water outlet opening 24. The hot water is passed under pressure through outlet control valve 98. The water pump 94 is necessary to deliver the hot water under pressure since the hot water within the water tower 12 will be more or less at atmospheric pressure. By the concepts of this invention, an exceedingly high efficiency of the utilization of the gross heat of combustion can be attained since the products of combustion escaping as flue gas through the vent 20 are typically at substantially the temperature of the inlet water flowing into the water distributor 68 which can be such as approximately 100° F. Thus, substantially all of the heat of the products of combustion is extracted and transferred to the water passing downwardly through the water tower.

A primary advantage of the present invention, as illustrated in the preferred embodiment, is that the flame of combustion takes place within the combustion chamber 28 and is not exposed to the downward flow of water. Thus, water does not contact the flame of combustion, thereby, possibly extinguishing the flame or resulting in an incomplete combustion of the gas. At the same time, all of the products of combustion are intimately mixed with the water to be heated.

The claims in the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A high efficiency gas hot water heater comprising:

a water tower having a vertical cylindrical wall, an upper and a lower end, having a exhaust gas vent in the upper end, having a hot water outlet adjacent the lower end, having a large diameter combustion gas inlet opening in the cylindrical wall intermediate the upper and lower end and having a water inlet opening adjacent the upper end;

a cylindrical combustion chamber secured to said water tower at said large diameter opening therein and extending at least substantially horizontally from said water tower, the combustion chamber having an inner end secured to said water tower, and having a burner mounted on the outer end, the burner having a gas inlet opening;

air blower means secured to said burner providing compressed air to the interior of said burner, the burner providing a flame extending into said combustion chamber;

a water jacket surrounding at least a substantial portion of said horizontal combustion chamber providing a closed annular area between the interior of the water jacket and the exterior of said combustion chamber, the water jacket having a water inlet and a water outlet;

a water distribution means positioned within said water tower adjacent said upper end and connected to said water inlet;

means to connect inlet water to said water jacket water inlet; and means connecting said water jacket water outlet to said water tower water inlet;

whereby gas and air are mixed and burned within said combustion chamber, the heated products of combustion flowing into said water tower and upwardly therein to pass out through said exhaust gas vent, the heated products of combustion encountering water passing downwardly within water tower to exchange heat with the water, the heated water being withdrawn through said water tower hot water outlet.

2. A high efficiency gas hot water heater according to claim 1 including:

a foranimous shelf positioned within said water tower above said combustion gas inlet opening and below said water distribution means; and packing positioned within said water tower on said shelf and extending upwardly to a height below said water distribution means, the packing permitting water to flow downwardly therethrough and products of combustion to flow simultaneously upwardly therethrough.

3. A high efficiency gas hot water heater according to claim 2 including:

a foranimous cover positioned within said water tower above said packing and below said water distribution means, the cover securing to retain said packing between it and said shelf.

4. A high efficiency gas hot water heater according to claim 1 wherein said water jacket has an inner end and an outer end, the outer end being in the form of an annular ring closing said water jacket to said combustion chamber, and the inner end being forward by the exterior surface of said water tower.

5. A high efficiency gas hot water heater according to claim 1 wherein a very high percentage of the gross heat available from said products of combustion is absorbed by the water passing through said water tower.

* * * * *